United States Patent [19]

Harman

[11] Patent Number: 5,044,132

[45] Date of Patent: Sep. 3, 1991

[54] VEHICLE PROTECTIVE COVER ASSEMBLY

[76] Inventor: John T. Harman, 630 Elbert St., Sullivan, Mo. 63080

[21] Appl. No.: 528,558

[22] Filed: May 24, 1990

[51] Int. Cl.[5] ..... E04B 7/16

[52] U.S. Cl. ..... 52/66; 135/88

[58] Field of Search ..... 52/64, 66; 135/88

[56] References Cited

U.S. PATENT DOCUMENTS

| | | | |
|---|---|---|---|
| 2,740,997 | 4/1956 | Gipslis . | |
| 2,853,745 | 9/1958 | Gipslis . | |
| 3,060,520 | 10/1959 | Schutmaat . | |
| 3,258,886 | 7/1966 | Button | 52/64 |
| 3,343,311 | 9/1967 | Wright . | |
| 3,367,073 | 2/1968 | Seeger . | |
| 3,438,158 | 4/1969 | Kane . | |
| 4,296,575 | 10/1981 | Verable et al. | 52/66 |
| 4,583,331 | 4/1986 | Hunt et al. | 135/102 |
| 4,834,128 | 5/1989 | Burgess | 135/88 |

FOREIGN PATENT DOCUMENTS

| | | | |
|---|---|---|---|
| 830697 | 4/1952 | Fed. Rep. of Germany | 52/64 |
| 2031651 | 6/1972 | Fed. Rep. of Germany | 52/64 |

*Primary Examiner*—Richard E. Chilcot, Jr.
*Assistant Examiner*—Joanne C. Downs
*Attorney, Agent, or Firm*—Andsel Group, Inc.

[57] ABSTRACT

A vehicle protective cover assembly having a base frame, an elongated vehicle shell-like cover and structure for pivoting the rear end of the vehicle shell-like cover upwardly about its front end and the base frame so that a vehicle can be driven under the cover.

4 Claims, 1 Drawing Sheet

VEHICLE PROTECTIVE COVER ASSEMBLY

BACKGROUND OF THE INVENTION

The invention relates to a protective cover and more specifically to one designed to be used for covering a vehicle.

Presently there are various types of covers for vehicles that are normally parked outdoors. The most common of these is a fabric cover that is stretched over the vehicle when parked. When the vehicle is in use, the cloth cover is folded and stored in the trunk.

More elaborate covers for vehicles have been designed having a rigid shell-like structure. The Gipslis U.S Pat. No. 2,740,997 discloses a shelter for vehicles whose cover pivots about rack and gear structure to uncover the vehicle. A second Gipslis U.S. Pat. No. 2,853,745 discloses a different type of mechanical structure for lifting the shell-like cover.

The Schutmaat U.S. Pat. No. 3,060,520 discloses a vehicle protective port that only covers the top portion of the vehicle and does not enclose the sides of a vehicle. The Button U.S. Pat. No. 3,258,886 is also directed to a tiltable vehicle shelter that uses a pair of lever arms combined with coil springs to raise and lower the shell-like cover. Seeger et al in U.S. Pat. No. 3,367,073 discloses a ribbed unitary tiltable shelter. The Wright U.S. Pat. No. 3,343,311 discloses a vehicle cover that is pivotal laterally. The Kane U.S. Pat. No. 3,438,158 discloses a carpod that is tiltable open by use of cable and pulley structure.

It is an object of the invention to provide a novel vehicle protective cover assembly having simple mechanical operating structure.

It is also an object of the invention to provide a novel vehicle protective cover assembly that utilizes a molded fiberglass shell-like cover.

It is another object of the invention to provide a novel vehicle protective cover assembly that is easily operated and which requires no manual exertion by the driver.

It is an additional object of the invention to provide a novel vehicle protective cover assembly that is easy to manufacture and assemble.

SUMMARY OF THE INVENTION

The novel vehicle protective cover assembly has a fiberglass cover that completely houses a car and provides it with a durable weatherproof protection. A base frame may be anchored to the ground for support. The base frame has a pair of laterally spaced U-shaped frame members that are connected together at their front end by a frame cross-member. When the cover is swung into its downward position, the lower edges of the cover are received in the channels formed by the U-shaped frame members.

A post extends vertically from the frame cross member and it has a pulley mounted adjacent its top end. A winch is also mounted on the frame cross-member and a cable is attached thereto and wound around the pulley adjacent the top of the post and its free end is secured to an eyelet bolt extending outwardly from the window cover section of the shell-like cover. An electric motor is connected through a pair of sprocket gears and chain to operate the winch.

Structure is also formed adjacent the bottom front wall of the shell-like cover for pivoting the front end about an axle that is journaled in pillow block bearings attached to the respective U-shaped frame members of the base.

The vehicle protective cover can be made in different sizes according to the dimensions of different cars. The form of the shell-like cover is contoured to the shape of the car. Optional features include a heater, timer and remote control system.

DESCRIPTION OF THE PREFERRED EMBODIMENT

Figures 1, 2:
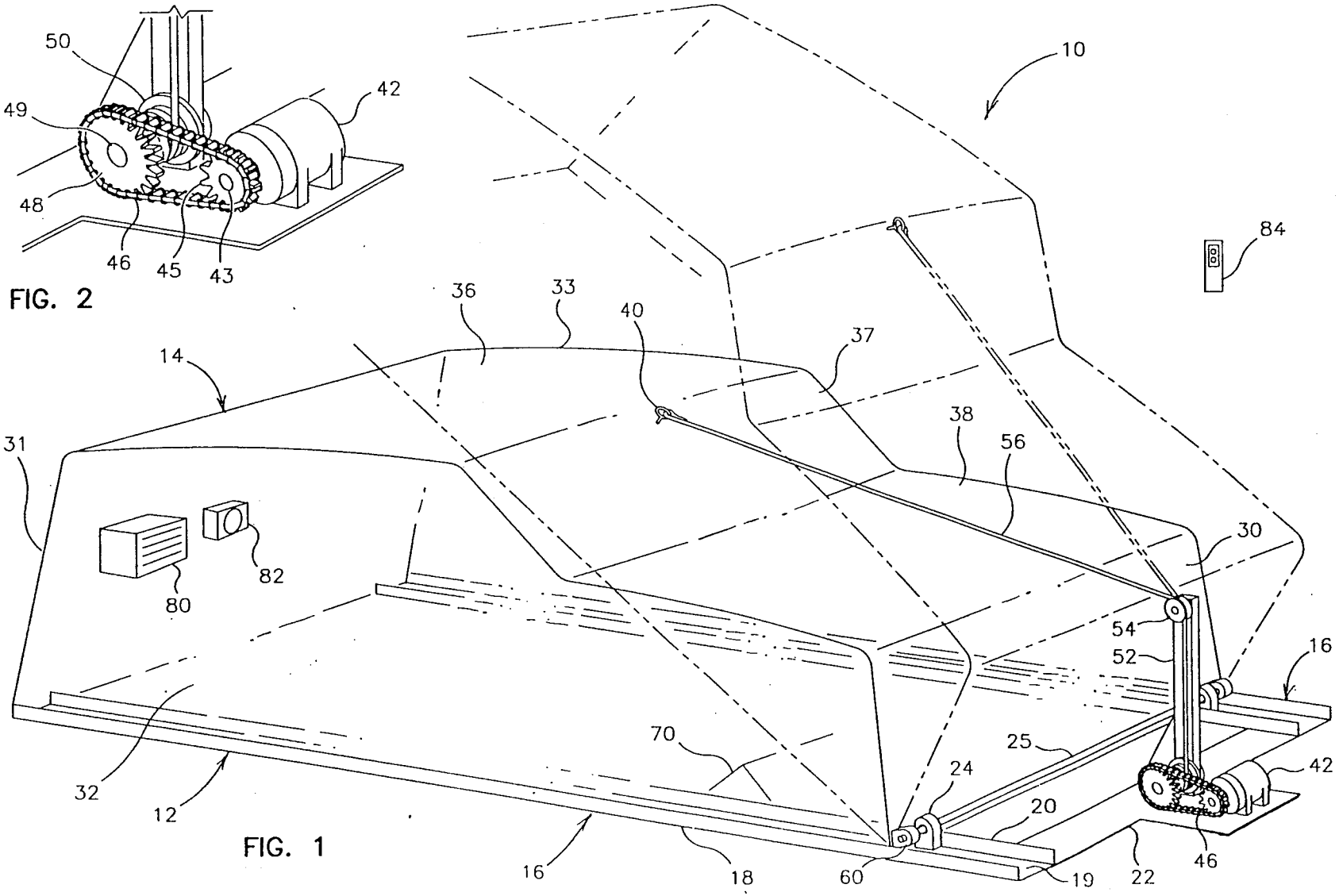
FIG. 1 is a front perspective view illustrating the novel vehicle protective assembly with phantom lines showing the cover assembly in its open position.
FIG. 2 is an enlarged perspective view of the electric motor and drive train.

Applicant's novel vehicle protective cover assembly will now be described by referring to FIG. 1 of the drawings. The vehicle protective cover assembly is generally designated numeral 10.

Vehicle protective cover assembly 10 has a base frame 12, a vehicle shell-like cover 14, and structure for pivoting the rear end of the vehicle shell-like cover upwardly about its front end so that a vehicle can be driven under the cover.

Base frame 12 has a pair of laterally spaced U-shaped frame members 16. These U-shaped frame members each have an outer side wall 18, a bottom wall 19 and an inner side wall 20. The front end of the U-shaped frame members 16 are connected together by a frame cross-member 22. Pillow block bearings 24 are mounted in the respective channels adjacent the forward end of frame members 16. An axle 25 is journaled therein.

Vehicle shell-like cover 14 has a front wall 30, a rear wall 31, and laterally spaced side walls 32 and 33. The top wall of vehicle shell-like cover 14 has a rear portion cover section 36, a window cover section 37, and a hood cover section 38. An eyelet bolt 40 is attached to window cover section 38.

An electric motor 42 having a driveshaft 43 is mounted on frame cross-member 22. Driveshaft 43 has a sprocket gear 45 mounted on its one end and a chain 46 passes around it and also a second sprocket gear 48 that is mounted on a shaft 49 extending outwardly from winch 50. A post 52 has its bottom end rigidly secured to frame cross-member 22. A pulley 54 is mounted adjacent the top end of post 52. A cable 56 has its one end connected to eye bolt 40 and its other end connected to winch 50.

A pair of bearing blocks 60 are attached to the front wall 30 of vehicle shell-like cover adjacent its bottom edge and the opposite ends of axle 25 are journaled in these bearing blocks 60. Thus when winch 50 is operated to reel in cable 56, vehicle shell-like cover 14 will pivot upwardly about an axis extending laterally through pillow blocks 60 and axle 25. Wheel chocks 70 control how far the vehicle is driven forwardly in under vehicle shell-like cover 14 when it is in its raised position.

A heater 80, timer 82 and remote control actuater 84 are options.

What is claimed is:

1. A vehicle protective cover assembly comprising:

a base frame formed from a pair of laterally spaced elongated U-shaped frame members each having a front end and a rear end, said U-shaped frame members having an outer upright wall, a bottom wall and inner upright wall and, a frame cross-member connecting the front ends of said U-shaped frame members;

an elongated vehicle shell-like cover having a front wall, a rear wall, laterally spaced side walls, and a top wall to form an enclosure open at its bottom;

means for pivoting the rear wall of said vehicle shell-like cover upwardly about its front wall so that a vehicle can be driven under said cover;

the top wall of said elongated vehicle shell-like cover having a hood cover section, a window cover section and a rear cover section said means for pivoting the rear wall of said vehicle shell-like cover upwardly about its front end comprising a post having a top end and a bottom end, said bottom end being secured to the frame cross-member of said base frame, a pulley mounted adjacent the top end of said post, an eyelet bolt secured to the window cover section of said vehicle shell-like cover, and a cable having one end secured to said eyelet, said cable being passed around said pulley.

2. A vehicle protective cover assembly as recited in claim 1 wherein said means for pivoting the rear wall of said vehicle shell-like cover upwardly about its front wall further comprises a winch having a driven shaft and the second end of said cable is secured to said winch, said winch being mounted on the cross member of said frame.

3. A vehicle protective cover assembly as recited in claim 2 further comprising an electric motor having a drive shaft that is mechanically connected to the driven shaft of said winch.

4. A vehicle protective cover assembly comprising:

a base frame formed from a pair of laterally spaced elongated U-shaped frame members each having a front end and a rear end, said U-shaped frame members having an outer upright wall and a bottom wall and inner upright wall, a frame cross-member connecting the front ends of said U-shaped frame members;

an elongated vehicle shell-like cover having a front wall and, a rear wall, laterally spaced side walls, and a top wall to form an enclosure open at its bottom;

means for pivoting the rear wall of said vehicle shell-like cover upwardly about its front wall so that a vehicle can be driven under said cover;

the top wall of said elongated vehicle shell-like cover having a hood cover section, a window cover section and a rear cover section;

said means for pivoting the rear wall of said vehicle shell-like cover upwardly about its front wall comprising a post having a top end and a bottom end, said bottom end being secured to the frame cross-member of said base frame, a pulley mounted adjacent the top end of said post, an eyelet bolt secured to the window cover section of said vehicle shell-like cover, and a cable having one end secured to said eyelet, said cable being passed around said pulley;

said means for pivoting the rear wall of said vehicle shell-like cover upwardly about its front wall further comprising a winch having a driven shaft, the second end of said cable being secured to said winch, said winch being mounted on the frame cross member of said base frame;

an electric motor having a drive shaft that is mechanically connected to the driven shaft of said winch; and a heater mounted in the interior of said vehicle shell-like cover and a remote control transmitter for turning said heater on and off.

* * * * *